US008095047B2

(12) United States Patent
Kurimoto et al.

(10) Patent No.: US 8,095,047 B2
(45) Date of Patent: Jan. 10, 2012

(54) FLUID CONTAINER DEVICE AND IMAGE FORMING APPARATUS

(75) Inventors: Hideaki Kurimoto, Yamato-koriyama (JP); Koichi Mihara, Hujiidera (JP); Toshihide Ohgoshi, Nara (JP); Hiroshi Kubota, Kadoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 471 days.

(21) Appl. No.: 12/345,716

(22) Filed: Dec. 30, 2008

(65) Prior Publication Data

US 2009/0180814 A1 Jul. 16, 2009

(30) Foreign Application Priority Data

Jan. 11, 2008 (JP) ..... 2008-004417

(51) Int. Cl.
*G03G 15/08* (2006.01)

(52) U.S. Cl. ..... 399/258; 399/261; 399/262

(58) Field of Classification Search ..... 399/119, 399/120, 238, 258, 261, 262, 263
See application file for complete search history.

(56) References Cited

U.S. PATENT DOCUMENTS

| | | | | |
|---|---|---|---|---|
| 4,611,730 | A * | 9/1986 | Ikesue et al. | 222/167 |
| 5,768,666 | A * | 6/1998 | Ito et al. | 399/260 X |
| 5,805,952 | A * | 9/1998 | Buch et al. | 399/120 X |
| 5,970,290 | A * | 10/1999 | Yoshiki et al. | 399/261 |
| 6,314,261 | B1 * | 11/2001 | Omata et al. | 399/261 |
| 7,162,190 | B2 * | 1/2007 | Deguchi | 399/258 |
| 2006/0133856 | A1 | 6/2006 | Deguchi et al. | |
| 2007/0286645 | A1 * | 12/2007 | Hayashi | 399/262 |

FOREIGN PATENT DOCUMENTS

| | | | |
|---|---|---|---|
| JP | 61-072271 | A | 4/1986 |
| JP | 2-166482 | | 6/1990 |
| JP | H06-194974 | A | 7/1994 |
| JP | 11-327275 | A | 11/1999 |
| JP | 2004-271995 | | 9/2004 |
| JP | H05-127530 | A | 5/2007 |
| JP | 2007-310133 | A | 11/2007 |

* cited by examiner

*Primary Examiner* — Sandra Brase
(74) *Attorney, Agent, or Firm* — Nixon & Vanderhye P.C.

(57) ABSTRACT

A toner supply container according to this invention includes a toner containing portion, a support member and a container holding member. The toner containing portion is a cylindrical container having a magnet at an outer periphery thereof and configured to discharge fluid contained therein. The support member supports the toner containing portion for rotation. The container holding member has a counterpart magnet at a position opposed to the former magnet and is configured to hold the toner containing portion supported by the support member.

9 Claims, 9 Drawing Sheets

FLUID CONTAINER DEVICE AND IMAGE FORMING APPARATUS

CROSS REFERENCE

This Nonprovisional application claims priority under 35 U.S.C. §119(a) on Patent Application No. 2008-4417 filed in Japan on Jan. 11, 2008, the entire contents of which are hereby incorporated by reference.

BACKGROUND OF THE TECHNOLOGY

The present technology relates to a fluid container device containing fluid therein, and an image forming apparatus including the fluid container device.

In recent years, a toner supply method for image forming apparatus which includes replacing an empty toner supply container with a fresh one has been mainstream in place of a toner supply method including supplying a toner hopper with toner from a toner supply container, in view of advantages including a low possibility of operator's hands being stained and a like advantage. Such a toner supply container, however, involves a problem that toner particles agglomerate and become solid by their own weights to prevent smooth toner supply into an image forming apparatus. One known toner supply container has an arrangement provided with an agitation blade inside the container. Such a toner supply container has a problem of a higher cost.

To overcome this problem, another known toner supply container is capable of containing toner without causing agglomeration of toner particles by a relatively simple structure (see Japanese Patent Laid-Open Publication No. 2004-271995 for example).

The toner supply container disclosed in Japanese Patent Laid-Open Publication No. 2004-271995 has a bottomed tubular shape and is configured to rotate within an image forming apparatus so as to feed toner by means of a spiral ridge formed on an internal surface of the toner supply container, thereby supplying an image forming apparatus body with toner. This toner supply container is capable of preventing agglomeration of toner particles and supplying toner smoothly by a low-cost structure.

The toner supply container can be rotated by application of a driving force from one end thereof. Therefore, the use of the toner supply container makes it possible to eliminate the need to provide a complicated driving mechanism, thereby offering an excellent space efficiency.

The toner supply container disclosed in Japanese Patent Laid-Open Publication No. 2004-271995, however, has a problem that toner adheres to the internal wall of the toner supply container and remains within the container without being discharged. Particularly where small-particle toner having a high cohesive force is used, a further increase occurs in the amount of residual toner that remains as adhering to the internal wall without being discharged.

Though the toner supply container is exemplified here, a similar problem sometimes arises with fluids other than toner.

It is an object of the present technology to provide a fluid container device which is capable of preventing fluid from adhering to an internal wall of a fluid containing portion, thereby reducing the amount of residual fluid that remains within the fluid container device without being discharged therefrom.

SUMMARY OF THE TECHNOLOGY

A fluid container device includes a fluid containing portion, a support portion and a holding portion. The fluid containing portion is a cylindrical container having a first magnet at an outer periphery thereof and configured to discharge fluid contained therein. The support portion supports the fluid containing portion for rotation. The holding portion has a second magnet at a position opposed to the first magnet and is configured to hold the fluid containing portion supported by the support portion.

With this construction, the fluid containing portion is vibrated by an interaction between the first and second magnets which occurs with rotation of the fluid containing portion, thereby making it possible to shake off fluid adhering to an internal wall of the fluid containing portion. Accordingly, it is possible to reduce the amount of residual fluid that remains within the fluid container device without being discharged therefrom.

Thus, the fluid container device is capable of preventing fluid from adhering to the internal wall of the fluid containing portion, thereby reducing the amount of residual fluid that remains within the fluid container device without being discharged therefrom.

The foregoing and other features and attendant advantages will become more apparent from the reading of the following detailed description in conjunction with the accompanying drawings.

BRIEF DESCRIPTION OF THE DRAWINGS

FIG. 6 includes views illustrating how a fluid containing portion of the fluid container device vibrates; specifically.

FIG. 8 includes views illustrating how a fluid containing portion of the second embodiment of the fluid container device vibrates; specifically.

FIG. 9 includes views showing configurations of sections of concern of respective fluid container devices according to third to fifth embodiments; specifically.

DETAILED DESCRIPTION OF THE TECHNOLOGY

Hereinafter, a fluid container device according to the best mode of the technology and an image forming apparatus including the fluid container device will be described in detail with reference to the drawings.

Figure 1:
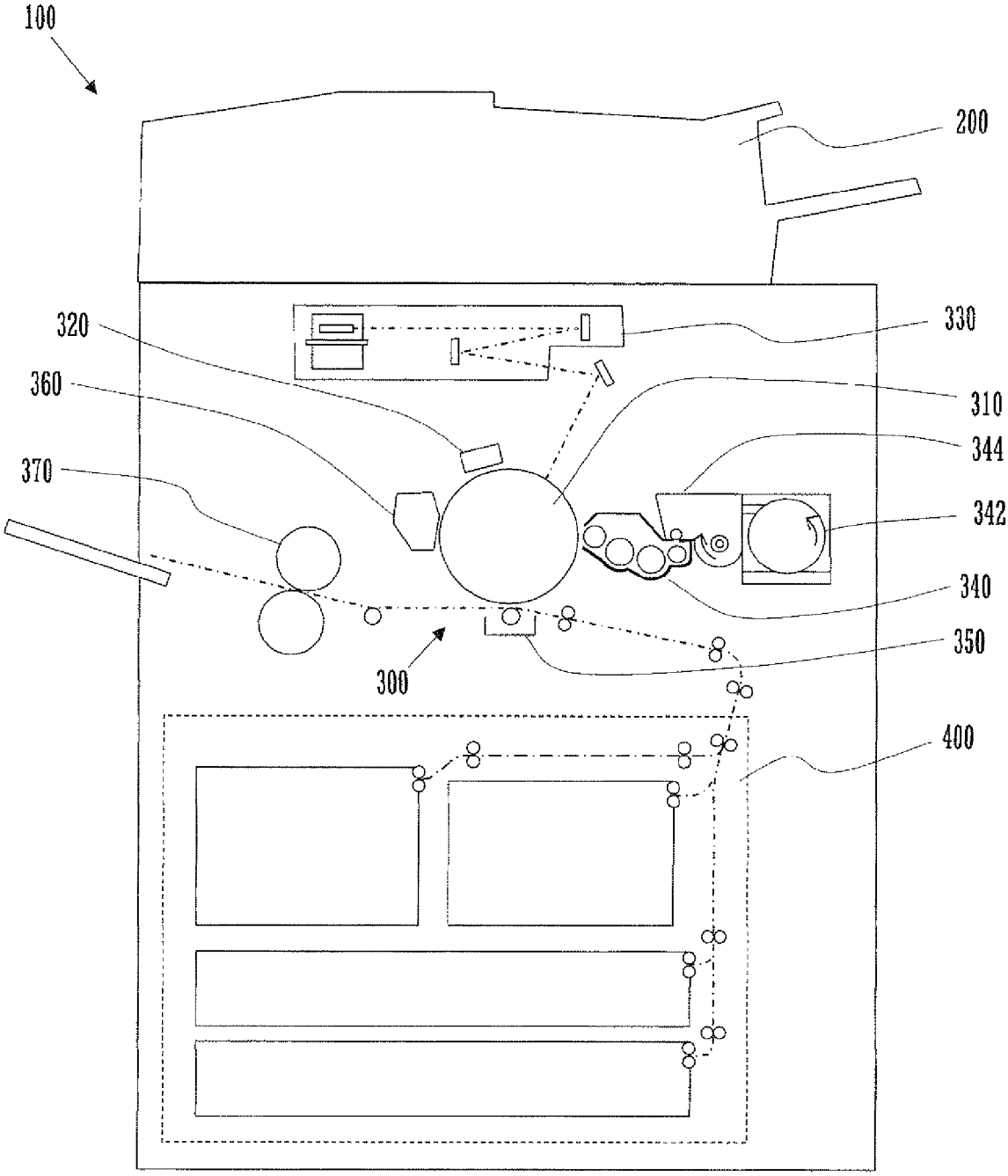
FIG. 1 is a view showing a configuration of an image forming apparatus including a fluid container device.

FIG. 1 is a view showing a configuration of an image forming apparatus including a fluid container device.

The image forming apparatus 100 includes an electrophotographic processing section 300 including a developing device 340. The developing device 340 is supplied with toner from a toner hopper 344, which in turn is supplied with toner from a toner supply container 342. In the present embodiment, the toner supply container 342 and the toner hopper 344 are disposed side by side. The toner supply container 342 is equivalent to the fluid container device defined by the technology.

The image forming apparatus 100 also includes a scanner 200 for reading an image of a document, a rotatable photosensitive drum 310 configured to carry an electrostatic latent image on a peripheral surface thereof for forming the image of the document read, an electrostatic charger device 320 for electrostatically charging the photosensitive drum 310, and an exposure device 330 having a laser beam scanner for forming on the photosensitive drum 310 the electrostatic latent image corresponding to the document image. The developing device 340 is configured to develop the electrostatic latent image.

The image forming apparatus 100 further includes a transfer device 350 configured to transfer a toner image developed on the photosensitive drum 310 by the developing device 340 to a sheet, a cleaning device 360 configured to remove residual toner remaining on the photosensitive drum 310, a sheet feeder device 400 configured to feed a sheet toward the photosensitive drum 310, and a fixing device 370 configured to fix the image to the sheet. Toner contained in the toner supply container 342 is supplied to the developing device 340 and finally fixed as an image on a sheet.

Figure 2:
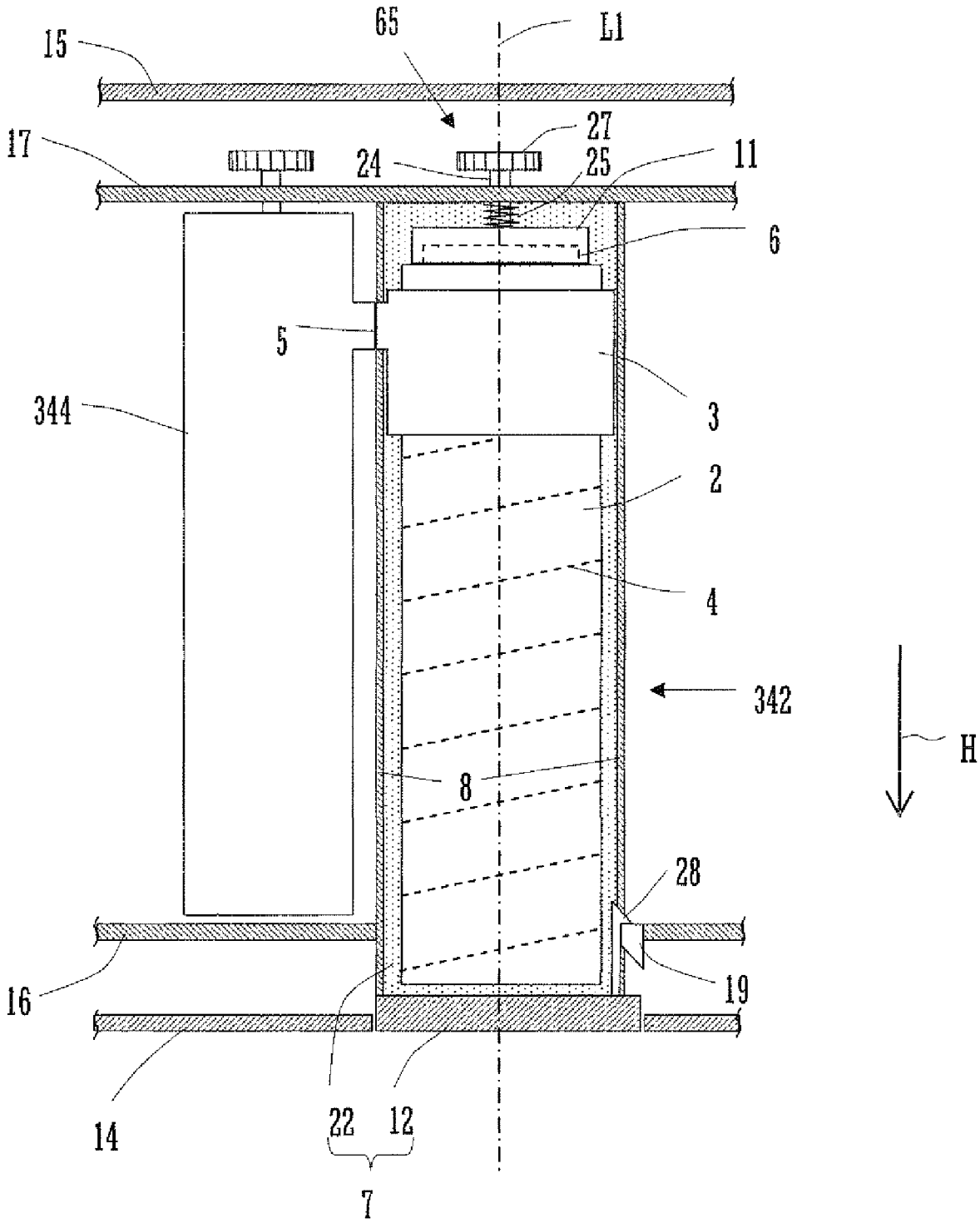
FIG. 2 is a view showing the fluid container device in a state of being fitted in the image forming apparatus.

FIG. 2 is a view showing the fluid container device in a state of being fitted in the image forming apparatus.

The image forming apparatus 100 has an outer periphery covered with a cover including a front cover portion 14 and a rear cover portion 15 which are opposed to each other. The front cover portion 14 is a portion which extends in front of a user when the user uses the image forming apparatus 100 in a normal manner. The rear cover portion 15 is a portion which extends on the reverse side of the image forming apparatus 100 when viewed from the user positioned in front of the front cover portion 14.

The toner supply container 342 includes a bottomed cylindrical toner containing portion 2 containing toner therein, and a support member 3 supporting the toner containing portion 2 for rotation about an axis L1. The toner containing portion 2 is equivalent to the fluid containing portion defined by the present invention. The support member 3 is equivalent to the support portion defined by the technology.

The toner containing portion 2 has a container-side coupling portion 6, a non-illustrated discharge port, and a toner guiding ridge 4. The container-side coupling portion 6 receives a rotation driving force transmitted from the image forming apparatus 100 via a body-side coupling portion 11.

The support member 3 supports the toner containing portion 2 by enveloping a part of the toner containing portion 2 over the entire circumference of the outer periphery thereof. The support member 3 is provided with a communication hole 5 for guiding toner discharged from the discharge port of the toner containing portion 2 to the toner hopper 344. A predetermined clearance is defined between the support member 3 and the toner containing portion 2. Therefore, the toner containing portion 2 is capable of vibrating when applied with a force.

The toner guiding ridge 4 is formed spirally on an inner peripheral surface of the cylindrical toner supply container 342 so as to meet the direction of rotation of the toner supply container 342. Thus, the toner supply container 342 feeds toner toward the discharge port while loosening toner by rotation about the axis L1.

The discharge port of the toner containing portion 2, which is provided for discharging toner present inside the toner containing portion 2, is formed at a location coinciding with the location at which the support member 3 is mounted. Toner discharged from the discharge port is guided to the toner hopper 344 through the communication hole 5 as the toner containing portion 2 rotates.

Figure 3:
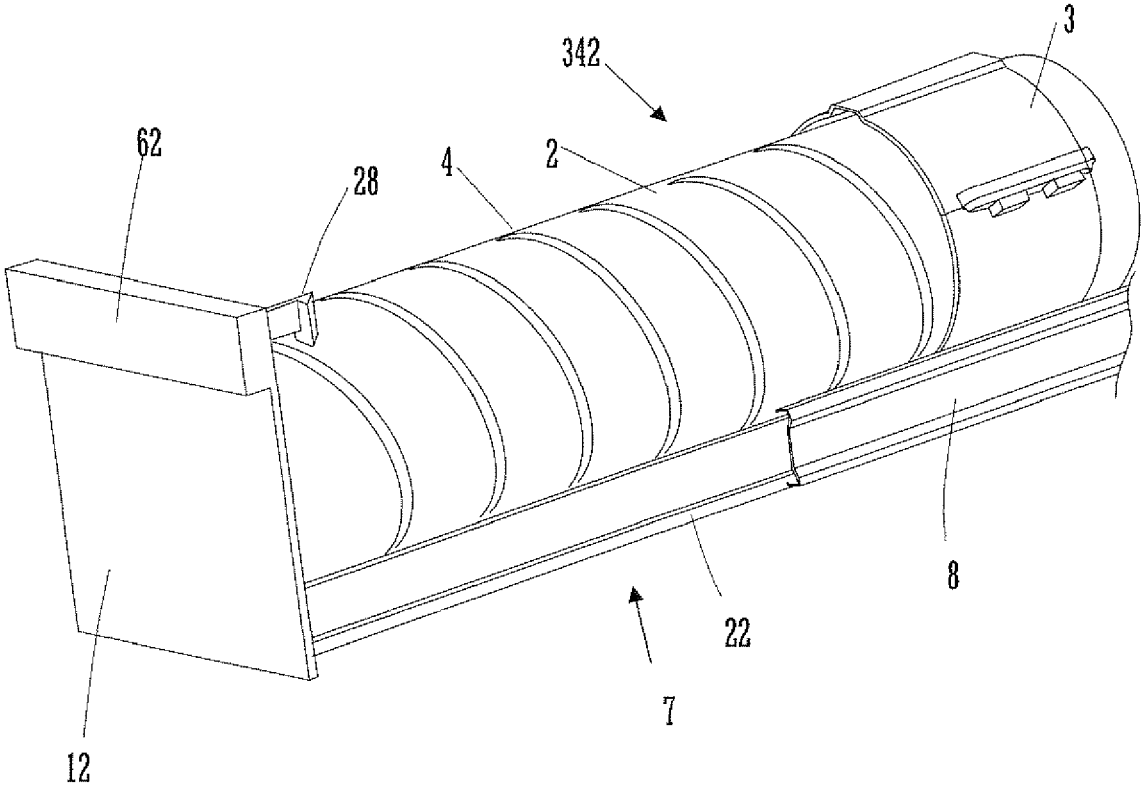
FIG. 3 is a view showing an outward appearance of the fluid container device.

FIG. 3 is a view showing an outward appearance of the fluid container device.

The toner containing portion 2 supported by the support member 3 is mounted on a container holding member 7. The container holding member 7 is equivalent to the holding portion defined by the technology. The toner containing portion 2 mounted on the container holding member 7 is fixed in a predetermined position on the container holding member 7.

The container holding member 7 includes a bottom wall portion 22 and a container fixing portion 61 (see FIG. 4) and is joined with a front wall portion 12. The bottom wall portion 22 extends in the front-rear directions of the image forming apparatus 100 and forms a base portion on which the toner containing portion 2 is placed. The container fixing portion 61, which is located on the bottom wall portion 22, removably holds the support member 3 supporting the toner containing portion 2 placed on the bottom wall portion 22 and fixes the toner containing portion 2 so as to prevent the toner containing portion 2 from moving along the axis L1.

The front wall portion 12 is located on the front side of the image forming apparatus 100 relative to the container holding member 7 and forms part of the front cover portion 14. The front wall portion 12 has a front surface formed with a grip 62 for drawing the container holding member 7 out of the image forming apparatus 100.

A space within the image forming apparatus 100 in which the container holding member 7 is accommodated is a non-illustrated container accommodating space for accommodating the toner supply container 342 therein. The container accommodating space has a rear end defined by a rear cabinet portion 17 and a front end extending through a front cabinet portion 16 and reaching the front cover portion 14. The front cabinet portion 16 and rear cabinet portion 17 are located between the front cover portion 14 and the rear cover portion 15.

The container holding member 7 is movable in the front-rear directions between its accommodated position in the container accommodating space and a position to which the container holding member 7 is drawn out of the container accommodating space toward the front.

Two guide members 8 are provided on the bottom wall portion 22 of the container holding member 7 in order to allow the container holding member 7 to move in the manner described above. That is, the container holding member 7 is held by the two guide members 8 which are expandable in parallel with the axis L1 from the rear cabinet portion 17 side to a position beyond the front cabinet portion 16. Thus, the container holding member 7 can be drawn out of the image forming apparatus 100 up to a position outside the front cover portion 14 in a drawing direction H with expansion of the guide members 8.

In order to reliably maintain the accommodated conditions of the container holding member 7 and toner containing portion 2 in the container accommodating space of the image forming apparatus 100, the front wall portion 12 and the front cabinet portion 16 are provided with a hook member 28 and an engagement member 19, respectively. The hook member 28 and the engagement member 19 engage each other fixedly when the container holding member 7 is completely accommodated in the container accommodating space of the image forming apparatus 100. The positions of the hook member 28 and engagement member 19 are not limited to those described above. The hook member 28 and the engagement member 19 may be provided on the front cabinet portion 16 and the front wall portion 12, respectively.

A driving force transmission mechanism 65 is provided at a position on the rear cabinet portion 17 facing the container accommodating space. The driving force transmission mechanism 65, which is provided for transmission of a rotation driving force to the toner containing portion 2, includes the body-side coupling portion 11, a rotating shaft 24, a push spring 25, and a gear 27. The rotating shaft 24 extends through the rear cabinet portion 17. A non-illustrated bearing portion is provided on the rotating shaft 24 at a position coinciding with the rear cabinet portion 17 for allowing the rotating shaft 24 to rotate.

The body-side coupling portion 11 placed in the container accommodating space is shaped like a disc and fixed to the rotating shaft 24 so as to be rotatable about the axis L1 together with the rotating shaft 24.

The push spring 25 comprising a coiled spring is placed between the rear cabinet portion 17 and the body-side coupling portion 11 and applies the body-side coupling portion 11 with a spring force biasing the body-side coupling portion 11 in a direction away from the rear cabinet portion 17 without interfering with rotation of the rotating shaft 24 and body-side coupling portion 11.

The gear 27 is fixed to an end of the rotating shaft 24 which is situated opposite away from the body-side coupling portion 11. The driving force for rotating the toner containing portion 2 is transmitted to the gear 27 from a non-illustrated drive source in the image forming apparatus 100.

Description will be made of magnets provided on the toner containing portion 2 and on the container holding member 7.

Figure 4:
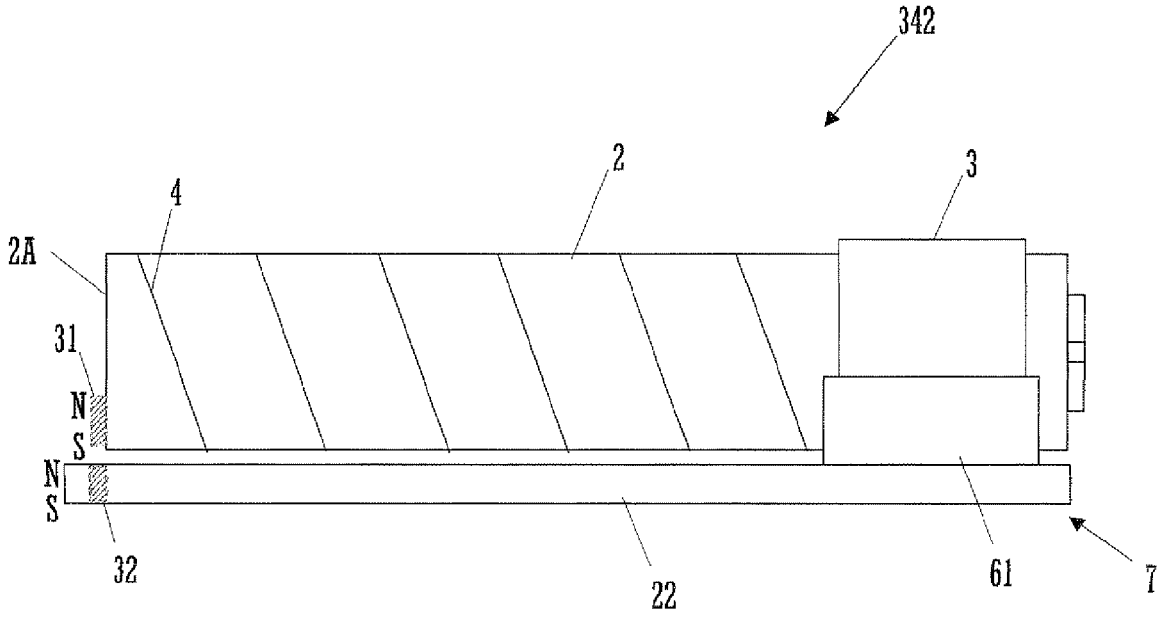
FIG. 4 is a view showing an outward appearance of the fluid container device.
Figure 5:
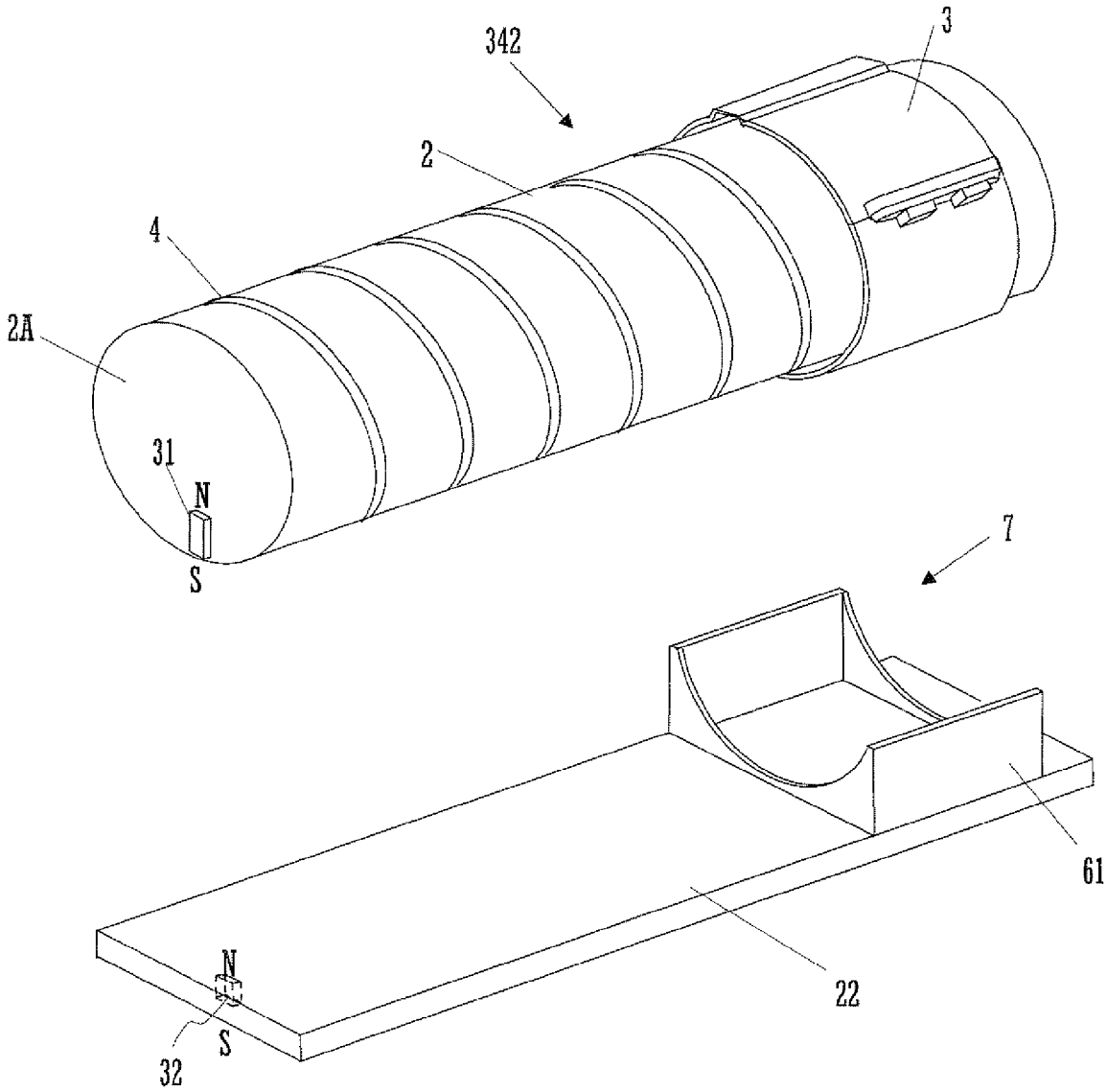
FIG. 5 is an exploded view of the fluid container device.

FIG. 4 is a view showing an outward appearance of the fluid container device. FIG. 5 is an exploded view of the fluid container device.

A magnet 31 is fixed to a peripheral portion of a bottom 2A of the cylindrical toner containing portion 2 with its south pole oriented radially outwardly. The magnet 31 revolves with rotation of the toner containing portion 2. A counterpart magnet 32 is provided on the bottom wall portion 22 of the container holding member 7 with its north pole oriented in a direction in which the magnets 31 and 32 attract each other when the magnet 31 comes close to the magnet 32. The magnet 31 is equivalent to the first magnet defined by the technology. The counterpart magnet 32 is equivalent to the second magnet defined by the technology.

When the toner containing portion 2 rotates, the toner supply container 342 is vibrated by the attractive force produced between the counterpart magnet 32 and the magnet 31 coming closer thereto. Such vibration shakes off toner adhering to the internal wall of the toner containing portion 2 to reduce the amount of toner adhering to the internal wall, thereby reducing the amount of residual toner that remains without being discharged. Since vibration is caused by the magnetic force of the magnets, there is no possibility of a reduction in the amplitude of vibration due to friction. Accordingly, it is possible to obtain stabilized vibration over a long period of time and reuse the toner supply container 342 repeatedly.

Preferably, the container holding member 7 is substantially horizontally positioned under the toner containing portion 2. This is because the toner containing portion 2 can be stably held by the container holding member 7 by virtue of its gravity and because the effect of each other's magnets can be easily exerted on the toner containing portion 2 and the container holding member 7.

The counterpart magnet 32 is preferably positioned so that a polarity thereof faces an opposite polarity of the magnet 31. With this arrangement the magnets cause the toner supply container 342 to vibrate at a larger acceleration than with an arrangement in which the magnets 31 and 32 are positioned so that a polarity of one magnet faces the same polarity of the other. Therefore, the effect of shaking off toner adhering to the internal wall can be enhanced.

The counterpart magnet 32 is preferably positioned so that the toner containing portion 2 (or the magnet 31) contacts the bottom wall portion 22 (or the counterpart magnet 32) only at a position at which the magnet 31 and the counterpart magnet 32 come closest to each other. With this arrangement, vibration by contact is added to vibration by the magnetic force to further enhance the effect of shaking off toner adhering to the internal wall.

FIG. 6 includes views illustrating how the fluid containing portion of the fluid container device vibrates.

Figure 6A:
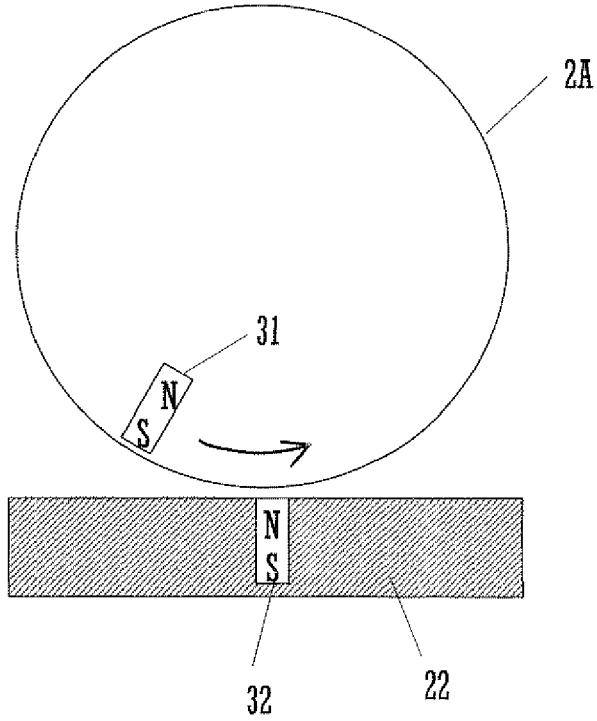
FIG. 6A shows a state in which a magnet is away from a counterpart magnet, so that a toner containing portion is free from the effect of a magnetic force.
Figure 6B:
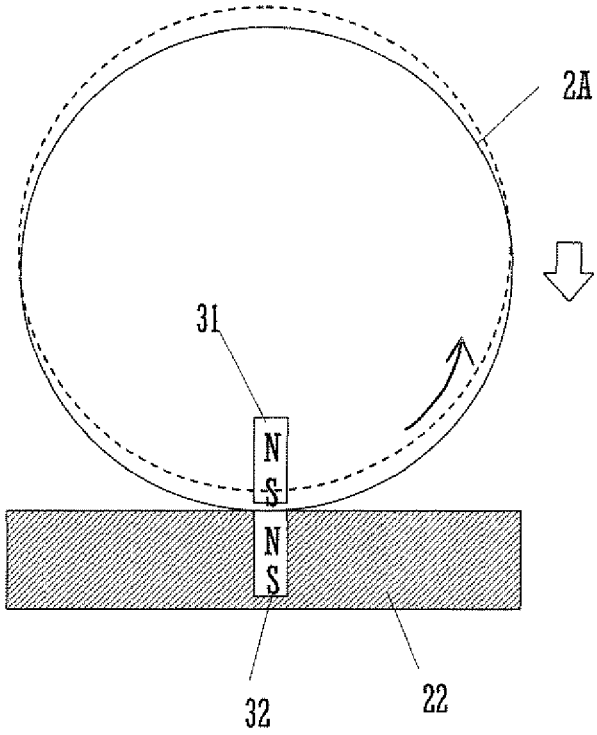
FIG. 6B shows a state in which the magnet comes closer to the counterpart magnet, so that the toner containing portion is moved downwardly to contact a bottom wall portion by the effect of the magnetic force.

FIG. 6A shows a state in which the magnet 31 is away from the counterpart magnet 32, so that the toner containing portion 2 is free from the effect of a magnetic force; and FIG. 6B shows a state in which the magnet 31 comes closer to the counterpart magnet 32, so that the toner containing portion 2 is moved downwardly to contact the bottom wall portion 22 by the effect of a magnetic force.

Figure 7:
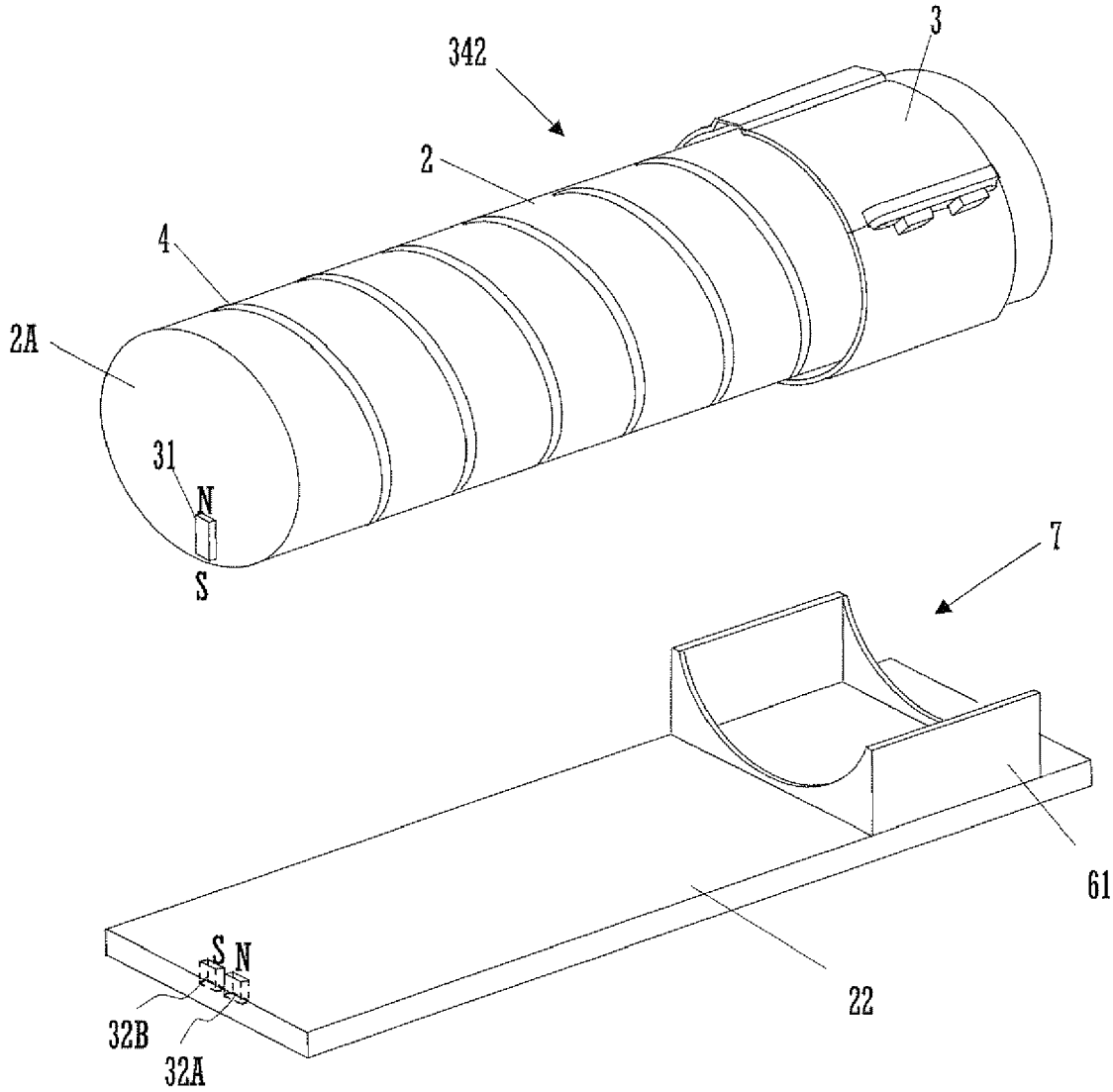
FIG. 7 is an exploded view showing a second embodiment of a fluid container device.

FIG. 7 is an exploded view showing a fluid container device according to a second embodiment.

The bottom wall portion 22 of the container holding member 7 is provided with a plurality of adjacent counterpart magnets 32A and 32B which are placed so that their respective different magnetic poles are oriented to specific positions on the course of rotation of the magnet 31.

FIG. 8 includes views illustrating how a fluid containing portion of the fluid container device according to the second embodiment vibrates.

Figure 8A:
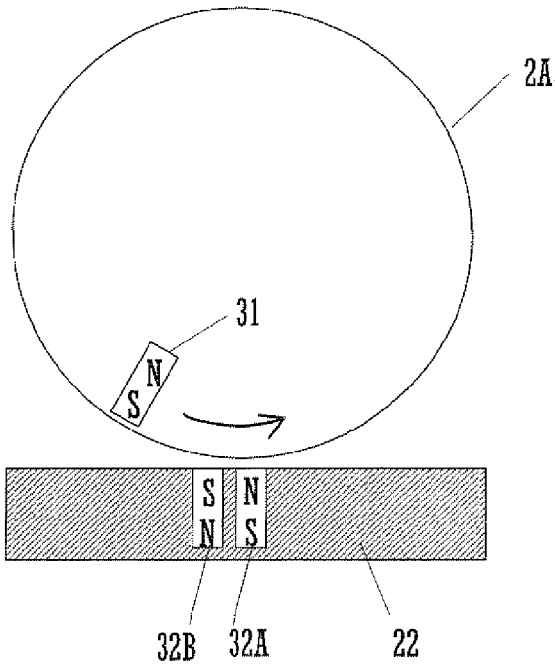
FIG. 8A shows a state in which a magnet is away from counterpart magnets, so that a toner containing portion is free from the effect of a magnetic force.
Figure 8B:
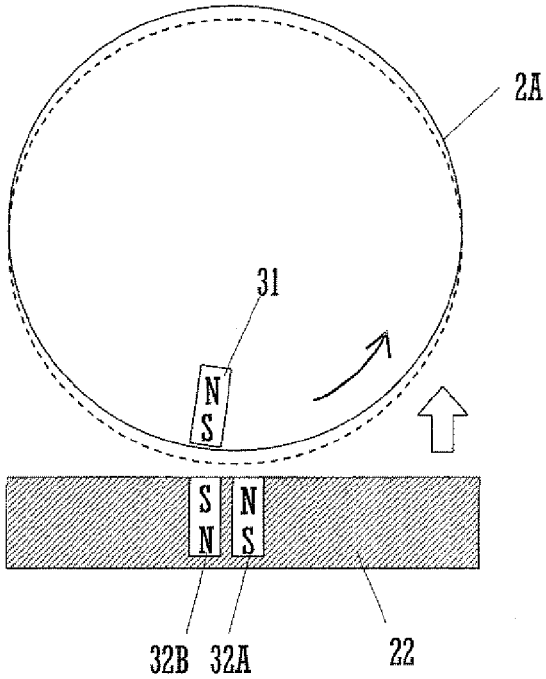
FIG. 8B shows a state in which the magnet comes closer to one counterpart magnet, so that the toner containing portion is moved upwardly by the effect of a magnetic force.
Figure 8C:
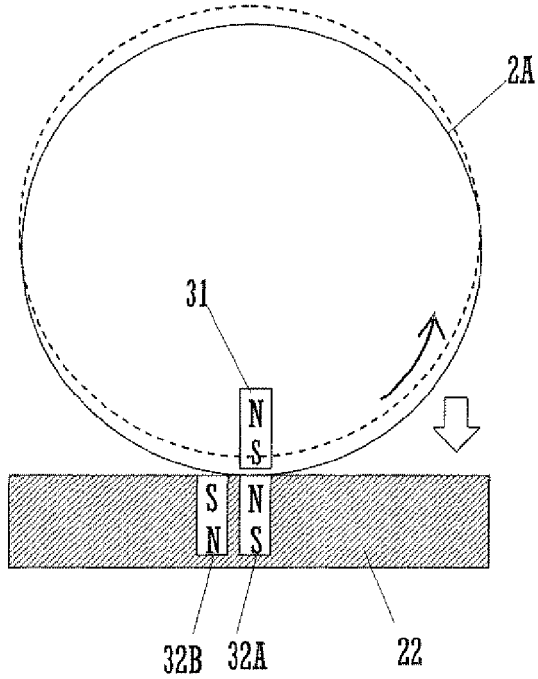
FIG. 8C shows a state in which the magnet comes closer to another counterpart magnet, so that the toner containing portion is moved downwardly to contact a bottom wall portion by the effect of a magnetic force.

FIG. 8A shows a state in which the magnet 31 is away from the counterpart magnets 32A and 32B, so that the toner containing portion 2 is free from the effect of a magnetic force. FIG. 8B shows a state in which the magnet 31 comes closer to the counterpart magnet 32B, so that the toner containing portion 2 is moved upwardly by the effect of a magnetic force. FIG. 8C shows a state in which the magnet 31 comes closer to the counterpart magnet 32A, so that the toner containing portion 2 is moved downwardly to contact the bottom wall portion 22 by the effect of a magnetic force.

When the magnet 31 comes closer to the counterpart magnet 32B, the toner containing portion 2 is moved upwardly temporarily and, immediately thereafter, moved downwardly to contact the bottom wall portion 22 by a magnetic force produced between the magnet 31 and the counterpart magnet 32A. Accordingly, the toner supply container 342 vibrates vigorously. That is, a repulsion force produced between the magnet 31 and the counterpart magnet 32B is switched to an attractive force produced between the magnet 31 and the counterpart magnet 32A in a short time by movement of the magnet 31. For this reason, the toner supply container 342 can vibrate at a larger acceleration to further enhance the effect of shaking off toner adhering to the internal wall, thereby reducing the amount of residual toner that remains without being discharged.

Figure 9A:
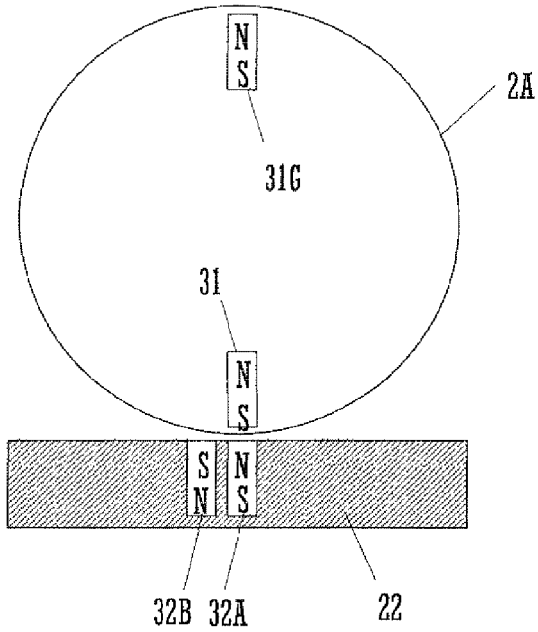
FIG. 9A is a view showing the configuration of the section of concern of the fluid container device according to the third embodiment.

FIG. 9A is a view showing the configuration of a section of concern of the fluid container device according to a third embodiment.

A magnet 31G, together with the magnet 31, is placed at a peripheral portion of the bottom 2A of the cylindrical toner containing portion 2 in a direction at an angle of rotation of 180° from the position of the magnet 31 about the axis of rotation of the toner containing portion 2, with its north pole being oriented radially outwardly.

Vibration caused by the magnet 31G and the counterpart magnets 32A and 32B enhances the effect of shaking off toner adhering to the internal wall of the toner containing portion 2, particularly, toner adhering to a portion of the internal wall on the magnet 31 side, thereby making it possible to further reduce the amount of residual toner that remains without being discharged.

Figure 9B:
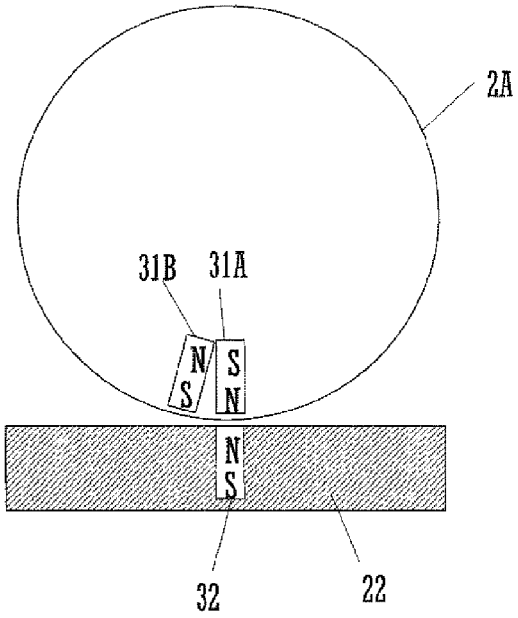
FIG. 9B is a view showing the configuration of the section of concern of the fluid container device according to the fourth embodiment.

FIG. 9B is a view showing the configuration of a section of concern of a fluid container device according to a fourth embodiment.

A plurality of adjacent magnets 31A and 31B are placed at a peripheral portion of the bottom 2A of the cylindrical toner containing portion 2, with their respective different magnetic poles being oriented radially outwardly.

When the magnet 31A comes closer to the counterpart magnet 32, the toner containing portion 2 is moved upwardly temporarily and, immediately thereafter, moved downwardly to contact the bottom wall portion 22 by a magnetic force produced between the magnet 31B and the counterpart magnet 32. Accordingly, the toner supply container 342 vibrates vigorously. That is, a repulsion force produced between the magnet 31A and the counterpart magnet 32 is switched to an attractive force produced between the magnet 318 and the counterpart magnet 32 in a short time. For this reason, the toner supply container 342 can vibrate at a larger acceleration to further enhance the effect of shaking off toner adhering to the internal wall, thereby reducing the amount of residual toner that remains without being discharged.

Figure 9C:
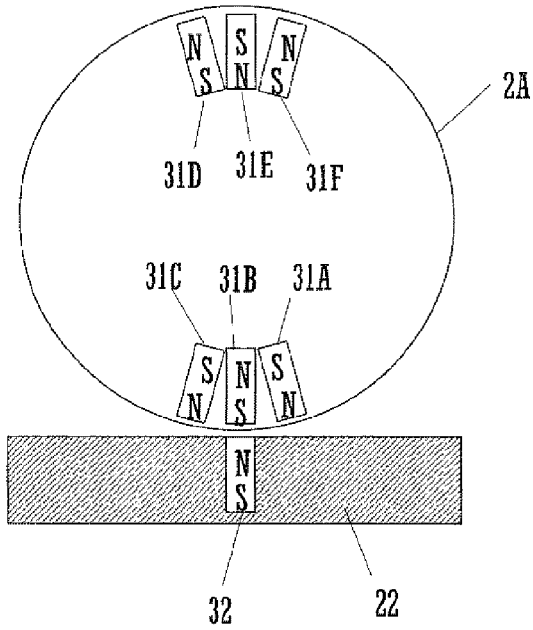
FIG. 9C is a view showing the configuration of the section of concern of the fluid container device according to the fifth embodiment.

FIG. 9C is a view showing the configuration of a section of concern of a fluid container device according to a fifth embodiment.

A plurality of adjacent magnets 31A, 31B and 31C are placed at a peripheral portion of the bottom 2A of the cylindrical toner containing portion 2, with their respective different magnetic poles being oriented radially outwardly in an alternating fashion. Also, a plurality of adjacent magnets 31D, 31E and 31F are placed at a peripheral portion of the bottom 2A of the cylindrical toner containing portion 2, with their respective different magnetic poles being oriented radially outwardly in an alternating fashion. The magnets 31D, 31E and 31F are positioned in directions at an angle of rotation of 180° from the positions of the respective magnets 31A, 31B and 31C about the axis of rotation of the toner containing portion 2.

Preferably, the counterpart magnet 32 or 32A is placed to face a position on the course of rotation of the magnet 31 at which the magnet 31 comes closest thereto. With this arrangement, acceleration by gravity is added to acceleration by the magnetic force to cause the toner supply container 342 to vibrate at a larger acceleration, thereby further enhancing the effect of shaking off toner adhering to the internal wall.

At least one of the magnets 31 and 31A to 31G and counterpart magnets 32, 32A and 32B is preferably an electromagnet. Since such an electromagnet can vary its magnetic force as desired by controlling the value of current passing therethrough, the intensity of vibration can be increased or decreased as occasion arises, for example, after the image forming apparatus 100 has been left at rest for a long time, or when toner in the toner containing portion 2 runs short. Thus, in cases where there is no need to vibrate the toner supply container 342, occurrence of noise in the image forming apparatus 100 can be suppressed by failing to produce a magnetic force. On the other hand, in cases where toner in the toner containing portion 2 runs short, the magnetic force can be strengthened to shake adhering toner off intensely.

The foregoing embodiments are illustrative in all points and should not be construed to limit the technology. The scope of the technology is defined not by the foregoing embodiments but by the following claims. Further, the scope of the technology is intended to include all modifications within the scopes of the claims and within the meanings and scopes of equivalents.

What is claimed is:

1. A fluid container device comprising:

a substantially cylindrical fluid containing portion having a first magnet at an outer periphery thereof and configured to discharge fluid contained therein;

a support portion supporting the fluid containing portion for rotation, the support portion bringing a first end of the fluid containing portion having the first magnet into a free state and keeping a second end of the fluid containing portion in a cantilever state; and a holding portion having a second magnet at a position opposed to the first magnet and holding the fluid containing portion supported by the support portion.

2. The fluid container device according to claim 1, wherein the holding portion is substantially horizontally positioned under the fluid containing portion.

3. The fluid container device according to claim 2, wherein the second magnet is placed so as to orient a magnetic pole thereof which attracts the first magnet to the second magnet.

4. The fluid container device according to claim 3, wherein the fluid containing portion contacts the holding portion at a position at which the first and second magnets come substantially closest to each other.

5. The fluid container device according to claim 1, wherein the second magnet comprises a plurality of magnets placed along a course of rotation of the first magnet such that magnetic poles of the respective magnets which are positioned adjacent to each other are different in polarity from each other.

6. The fluid container device according to claim 1, wherein the first magnet comprises a plurality of magnets placed in a direction of rotation of the fluid containing portion such that magnetic poles of the respective magnets which are positioned adjacent to each other are different in polarity from each other.

7. The fluid container device according to claim 1, wherein the second magnet is placed at a position at which the holding portion is substantially closest to a course of rotation of the first magnet.

8. The fluid container device according to claim 1, wherein at least one of the first magnet and the second magnet comprises an electromagnet.

9. An image forming apparatus comprising:

an image carrier configured to form an electrostatic latent image on a surface thereof; and a developing device having a fluid container device as recited in claim 1 and configured to supply a developer to the surface of the image carrier.

* * * * *